US006119758A

United States Patent [19]

Coenraets

[11] Patent Number: 6,119,758

[45] Date of Patent: Sep. 19, 2000

[54] CLOSURE DEVICE WITH A FLEXIBLE SCREEN

[75] Inventor: Benoit Coenraets, Humbeek, Belgium

[73] Assignee: Dynaco International, Brussels, Belgium

[21] Appl. No.: 08/737,068

[22] PCT Filed: Apr. 20, 1995

[86] PCT No.: PCT/BE95/00038

§ 371 Date: Jan. 3, 1997

§ 102(e) Date: Jan. 3, 1997

[87] PCT Pub. No.: WO95/30064

PCT Pub. Date: Nov. 9, 1995

[30] Foreign Application Priority Data

Apr. 29, 1994 [BE] Belgium ..... 9400439
Feb. 3, 1995 [BE] Belgium ..... 9500083

[51] Int. Cl.[7] ..... A47G 5/02

[52] U.S. Cl. ..... 160/273.1; 160/35

[58] Field of Search ..... 160/35, 36, 133, 160/270, 271, 272, 273.1, 310

[56] References Cited

U.S. PATENT DOCUMENTS

| | | | |
|---|---|---|---|
| 1,612,261 | 12/1926 | Burns | 160/273.1 |
| 1,677,230 | 7/1928 | Mercurio | 160/273.1 |
| 1,825,198 | 9/1931 | Negrini | 160/133 X |
| 2,349,226 | 5/1944 | Thomas | 160/273.1 |
| 3,017,218 | 1/1962 | Groth et al. | 160/201 X |
| 3,092,170 | 6/1963 | Ellis . | |
| 3,149,665 | 9/1964 | Handford | 160/272 X |
| 3,516,469 | 6/1970 | McDonald . | |
| 4,175,608 | 11/1979 | Alten | 160/273.1 |
| 4,601,320 | 7/1986 | Taylor . | |
| 4,610,293 | 9/1986 | Weiblen | 160/273.1 X |
| 4,966,217 | 10/1990 | Dechambeau et al. | 160/35 |
| 5,058,651 | 10/1991 | Ashley et al. | 160/271 |
| 5,123,474 | 6/1992 | Smith | 160/273.1 X |
| 5,176,194 | 1/1993 | Chigusa | 160/273.1 |
| 5,219,015 | 6/1993 | Kraeutler | 160/271 |
| 5,445,209 | 8/1995 | Lichy | 160/273.1 |
| 5,722,476 | 3/1998 | Sanchez et al. | 160/133 |

FOREIGN PATENT DOCUMENTS

| | | |
|---|---|---|
| 0 033 199 | 8/1981 | European Pat. Off. . |
| 0 252 839 | 1/1988 | European Pat. Off. . |
| 0 264 220 | 4/1988 | European Pat. Off. . |
| 0 397 619 | 11/1990 | European Pat. Off. . |
| 1 405 971 | 6/1965 | France . |
| 1 408 464 | 7/1965 | France . |
| 2 621 951 | 4/1989 | France . |
| 2 683 258 | 5/1993 | France . |
| 27 36 936 | 3/1978 | Germany . |
| 29 39 834 | 4/1981 | Germany . |
| 40 00 908 | 7/1991 | Germany . |

*Primary Examiner*—David M. Purol
*Attorney, Agent, or Firm*—Browdy and Neimark

[57] ABSTRACT

According to the invention, the lateral edges of the screen are substantially incompressible or rendered incompressible in their lengthwise direction. A driving device is provided making it possible to apply a thrust force to these edges in the longitudinal direction of the edges in their guide channels in order to move the screen towards its closed position and towards its open position. The screen is provided, near or on the lateral edges mentioned above, with a series of members which are substantially rigid in the longitudinal direction of these edges. These members are able to bear against one another in the direction of the lateral edges, and are preferably able to be articulated with respect to each other such as to allow the rolling up or flexion of the screen in its open position.

29 Claims, 16 Drawing Sheets

FIG. 30
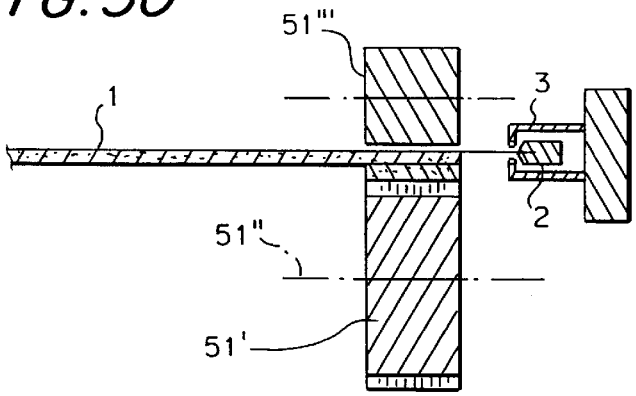
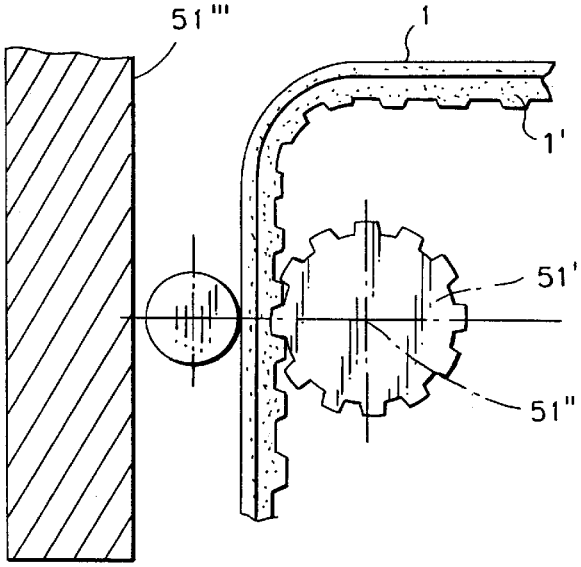
FIG. 31
FIG. 32
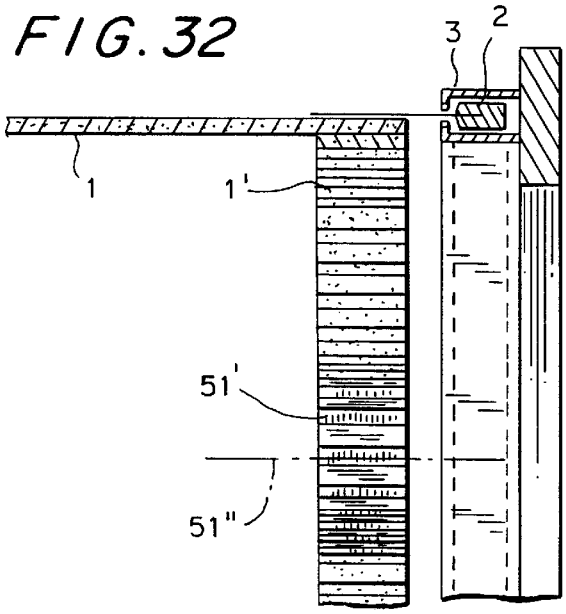

CLOSURE DEVICE WITH A FLEXIBLE SCREEN

BACKGROUND OF THE INVENTION

1. Technical Field of the Invention

The present invention relates to a closing device comprising a flexible screen, such as an awning, whose lateral edges are guided in guide channels, thus allowing the screen to be moved between a closed position and an open position.

2. Prior Art

Some prior art closing devices have a flexible screen with a weighting bar extending over the whole width of the screen on a lower edge to allow the closing of the screen essentially under the weight of this weighting bar and to maintain it in a taut condition.

The presence of such a weighting bar has various disadvantages. Thus, a result of inertia, the speeds of opening and closing are limited and special precautions must be taken in order to brake the upward and downward motion of the screen in a sufficient amount of time before its stoppage. Furthermore, the weight of such a weighting bar necessitates a relatively large amount of energy to bring the screen into its open position. Finally, reliable safety means must be provided in the screen's control circuit in order to prevent accidents when a person or any object is below the screen during its descent towards the closed position.

Other prior art closing devices are provided with driving means having return-pulleys which pull on the lateral edges of the screen to bring the latter into its closed position. In such a closing device, it is not essential to provide a weighting and stiffening bar at the lower edge of the screen. From a practical point of view, however, such a stiffening and weighting bar is generally necessary to ensure the correct functioning of the closure.

OBJECT AND SUMMARY OF THE INVENTION

One of the main purposes of the present invention is to provide a flexible screen closing device which no longer requires a stiffening and weighting bar.

For this purpose, according to the invention, the lateral edges of the screen are substantially incompressible or rendered incompressible in their lengthwise direction. Driving means are provided making it possible to apply a thrust force to these edges in the longitudinal direction of the edges in their guide channels in order to move the screen towards its closed position and towards its open position.

Advantageously, the screen is provided, near or on the lateral edges mentioned above, with a series of members which are substantially rigid in the longitudinal direction of these edges. These members are able to bear against one another in the direction of the lateral edges, and are preferably able to be articulated with respect to each other such as to allow the rolling up or flexion of the screen in its open position.

According to one embodiment of the invention, the rigid link members surround the lateral edges of the screen forming a protrusion with respect to the surface of the screen. This protrusion is held and moved in guide channels.

According to another embodiment of the invention, the screen has, in the vicinity of at least one of its lateral edges guide channels, stiffening means making it possible to render the edges substantially incompressible in their lengthwise direction. These stiffening means are formed by a notched belt integral with the screen and extending along at least one of the lateral edges of the screen. Driving means cooperate with the notched belt to open and close the screen.

The invention also concerns a closing device which does not necessarily require lateral edges which are compressible or rendered incompressible in the direction of their movement towards their closed position, along their length.

This device is characterized by the fact that the screen is substantially stretched between guide channels at least in the closed position, wherein means are provided to avoid the compression of the lateral edges (2) of the screen (1) in their lengthwise direction at least during the movement towards the closed position and the presence of a stiffening element near the free edge of the screen on the side of the closed position.

BRIEF DESCRIPTION OF THE DRAWINGS

Other details and features of the invention will emerge from the following description, given by way of non-limitative example, of several particular embodiments of the closing device according to the invention with reference to the accompanying drawings.

FIG. 30 is diagrammatic view of a partial horizontal section of a closing device according to a ninth embodiment of the invention.

FIG. 31 is a partial diagrammatic view in cross-section of this ninth embodiment.

FIG. 32 is a partial diagrammatic front view along the line XXXII of FIG. 31.

DETAILED DESCRIPTION OF THE PREFERRED EMBODIMENTS OF THE INVENTION

In the various figures, similar reference numbers relate to identical elements.

The closing device according to the invention and of which several particular embodiments are shown in the accompanying figures, comprises a flexible screen 1 whose lateral edges 2 are guided in guide channels 3 to allow the screen 1 to be moved between a closed position and an open position. These edges are preferably protruding with respect to the plane of the screen in order to allow them to be easily maintained in the guide channels.

The term "flexible screen" should be understood to mean, within the context of this invention, any flat element able to form a closure or a separation and able to roll around an axis or to be folded, such as an awning, a strip of plastic material, etc., intended for closing a bay, forming a separating partition, covering a swimming pool or producing a canopy. In this respect it should be noted that, according to the invention, a distinct preference is given to waterproof doors comprising thus a screen which is moved between two vertical guide channels.

In general, all the embodiments of the closing device according to the invention are characterized by the fact that the lateral edges 2 of the screen 1 are substantially incompressible or rendered incompressible in their lengthwise direction, in order to make it possible to apply to these edges a thrust in their longitudinal direction inside the guide channels 3 without them being able to form puckers which are capable of jamming these edges in these guide channels. Thus, drive means are also provided making it possible to act on these edges 2 in their guide channels 3 in order to move the screen 1 into its closed position and if necessary into its open position.

Figure 1:
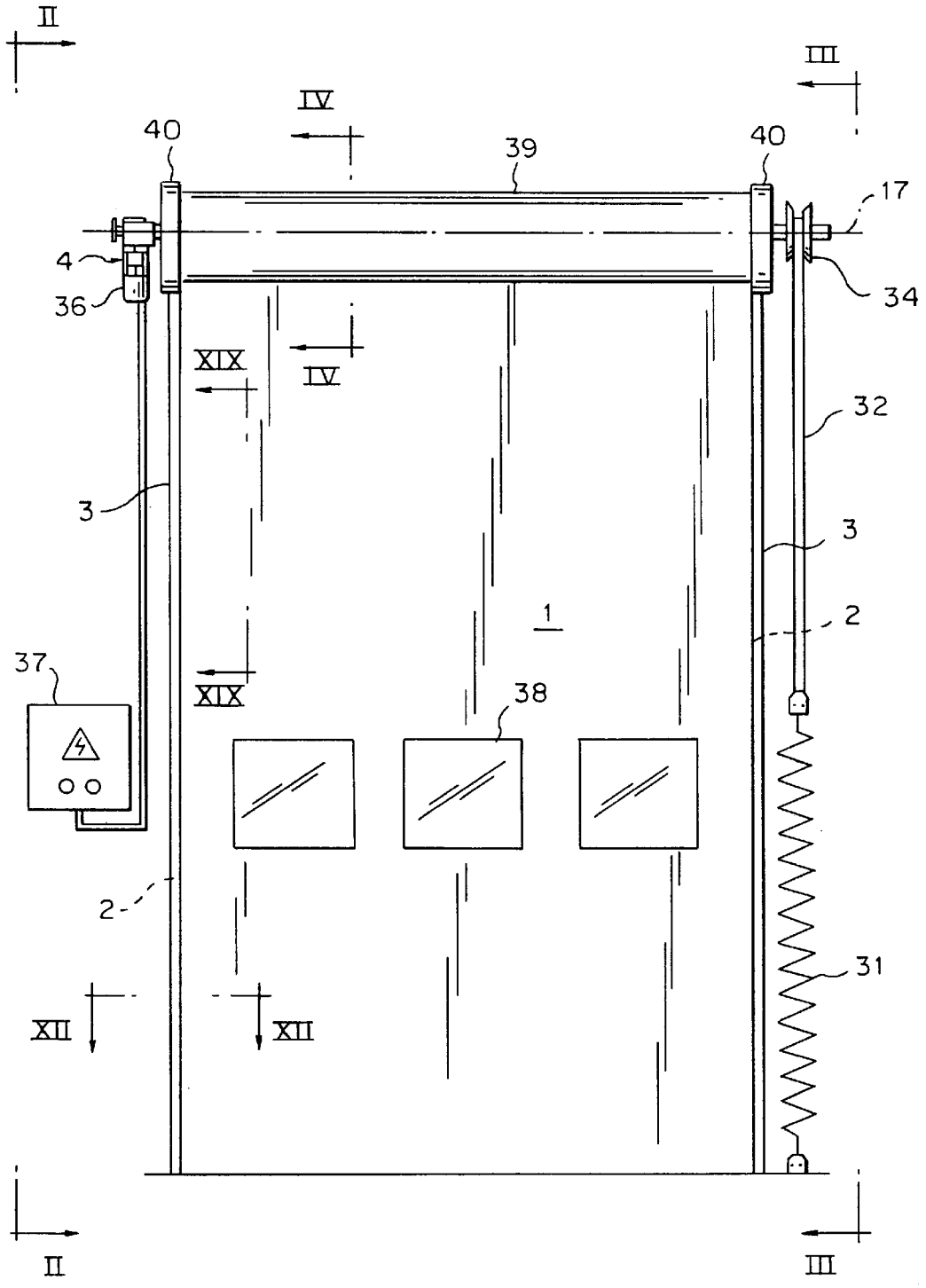
FIG. 1 is a diagrammatic view in front elevation of a closing device with a flexible screen according to a first embodiment of the invention, the screen being in the closed position.
Figure 2:
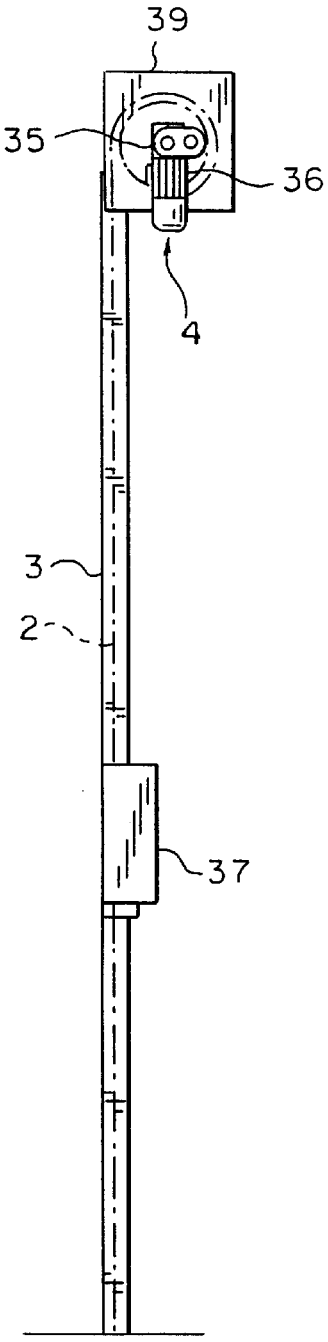
FIG. 2 is a view along the lines II—II of FIG. 1.
Figure 3:
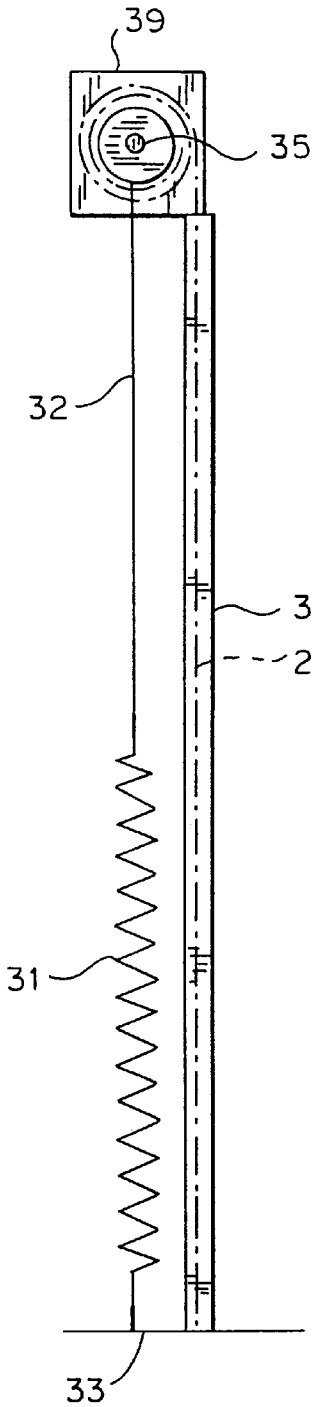
FIG. 3 is a view along the line III—III of FIG. 1.

According to the invention, the drive means are arranged in such a way as to make it possible to create a thrust force on the lateral edges 2 of the screen 1 in the longitudinal direction of the latter, thus causing the movement of the screen towards its closed position, as shown in FIG. 1.

In the embodiment shown in FIG. 1, the opening of the screen 1 is caused by a spring 31 fixed between the free end of a belt 32 and a fixed point on the base 33. When the screen 1 is being closed, this belt 32 winds on a pulley 34 fixed to a drive shaft 20 which is driven by a motor reduction unit 36, the latter being controlled from a control box 37. In this way, the spring 31 becomes stretched when the screen 1 is in its closed position, as shown in FIG. 1. This allows the rolling up automatically of the screen towards its open position when it is unlocked from this closed position.

In this embodiment, the screen 1 is formed by an awning with three windows 38 made from a transparent plastic material and which is rolled up in its open position inside a retainer box 39 having a square cross-section and closed at its two ends by flanges or cheeks 40.

Figure 4:
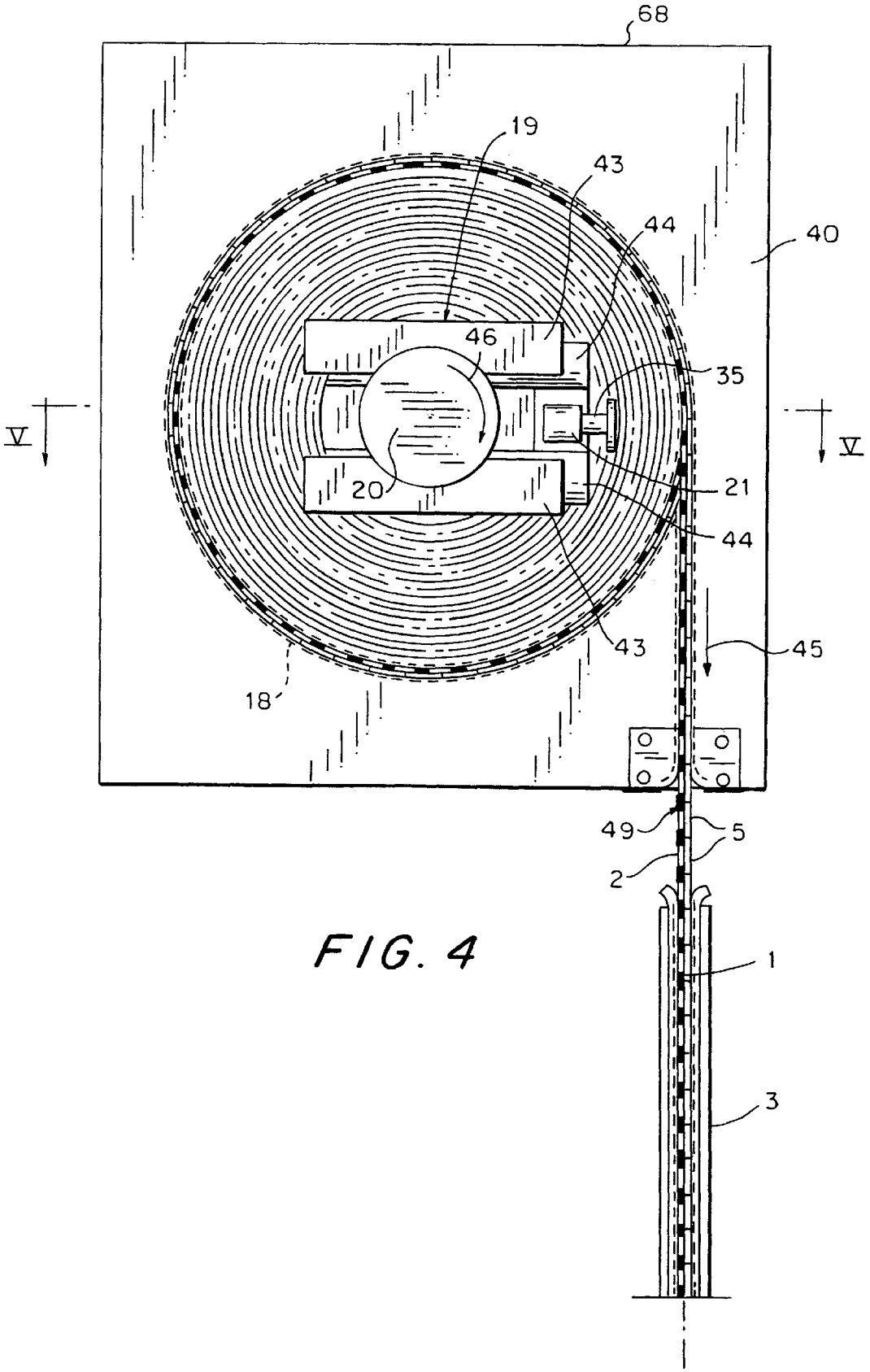
FIG. 4 is, on a large scale, a section along the line IV—IV of FIG. 1.
Figure 5:
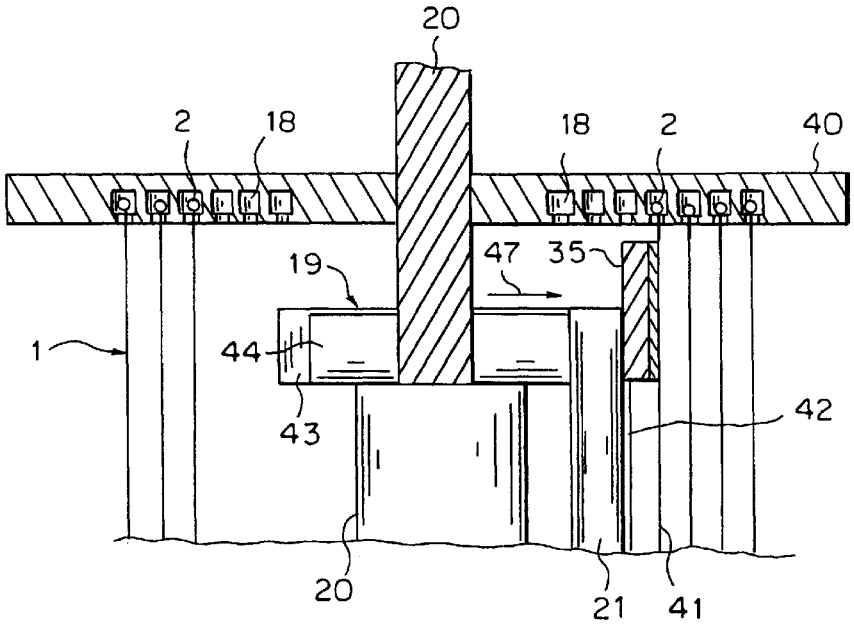
FIG. 5 is a section along the line V—V of FIG. 4.

These two flanges or cheeks 40 have, in their internal surfaces which face one another, spiral guide channels 18, as shown in detail in FIGS. 4 and 5.

As shown in FIG. 4, these spiral guide channels 18 extend in the prolongation of the straight guide channels 3.

In the first embodiment of the closing device according to the invention, shown in more detail in FIGS. 4 to 13, the screen 1 is provided, at its lateral edges 2, with a series of protruding rigid link members 5 which are at least rigid in the longitudinal direction of these lateral edges 2. These member 5 bear against one another in this longitudinal direction and are articulated with respect to one another, in such a way as to allow the rolling up of the screen 1 inside the box 39, when it is placed in its open position.

As shown in particular in FIGS. 8 to 13, these rigid link members 5 surround the lateral edges 2 of the screen 1 forming a protrusion 6 on either side with respect to the plane of screen 1 and slide with a certain friction in the guide channels 3 and 18, in order to prevent the screen from moving between the open position and the closed position under its own weight. An advantage of this is that no special braking means at the ends of travel of the screen are needed.

In this same embodiment, the lateral edges 2 of the screen 1 have a substantially continuous bead 7 around which the rigid link members 5 are fixed.

Advantageously, this bead comprises a hollow pipe 8 able for example to contain a fluid or an electric current conductor.

In the embodiment shown in FIGS. 6 to 13, this pipe contains a gas, such an air 41, of any pneumatic safety system which is not shown. Such a pipe 8 is thus perfectly protected both by the rigid link members 5 and by the guide channels 3 in which these members are moved.

In the first specific embodiment shown in FIGS. 6 to 13 in particular, the rigid link members 5 comprise sleeves 6 having in their wall a longitudinal slot 9 through which the screen 1 emerges from the sleeves, thus defining two flanges 10 and 11 extending on either side of the screens. The flange 10 has a length in the direction of the lateral edges 2 of the screen which is less than that of the other flange 11, such that a gap 12 is formed on one side of the screen 1 between two consecutive members 5, thus allowing the flexion of the edge 2 transversely in the plane of the screen on the above-mentioned side (see FIG. 9). The other flanges 11 of these members 5 bear against one another end-to-end in the longitudinal direction of these lateral edges 2 of the screen 1 (see FIG. 8).

More precisely, in this embodiment, the shortest flange 10 of the rigid member 5 has a length equal to half that of the other flange 11 and is located symmetrically with respect to the other flange 11, in such a way as to form, facing the latter and on either side of the shortest flange 10, a gap 12, having a length which is half of that of the flange 11.

Figure 7:
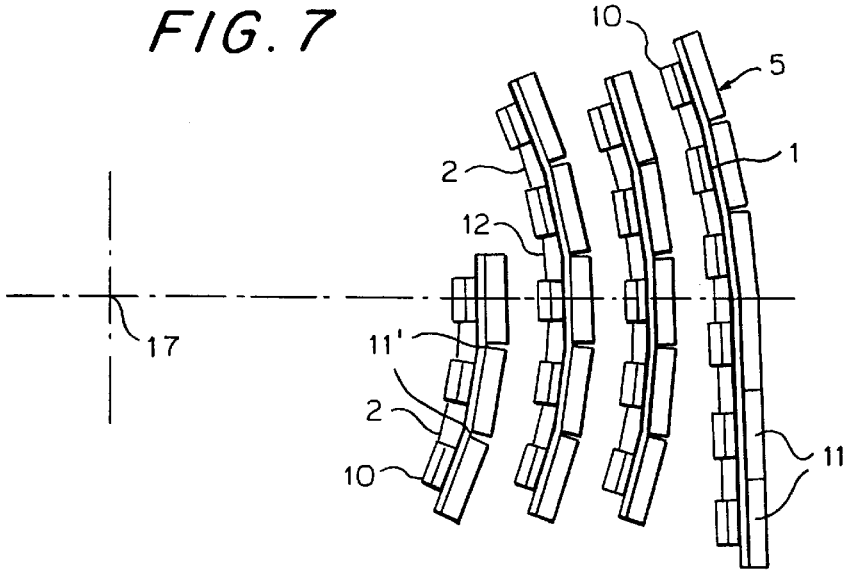
FIG. 7 is a diagrammatic view rather similar to that of FIG. 4, but on a larger scale and more diagrammatic, showing certain parts of FIG. 4 in more detail.

FIG. 7 shows, in a diagrammatic way, the behavior of these specific rigid link members 5 during the rolling up of the screen. It can be seen that the rolled lateral edges can pucker freely in the gaps 12, thus facilitating their flexion.

The fact that the flange 10, located on the side of the center of curvature of the spiral guide channel 19, is shorter than the opposite flange 11 of the rigid members 5, makes it possible, furthermore, to prevent the movement of these members 5 over the lateral edges 2 of the screen 1 during the rolling up of the latter into its open position. In fact, as shown clearly in FIG. 7, two consecutive rigid members are articulated about the neutral axis of the lateral edges 2 whilst remaining in contact with each other at the place 11' located on this neutral axis.

Figure 6:
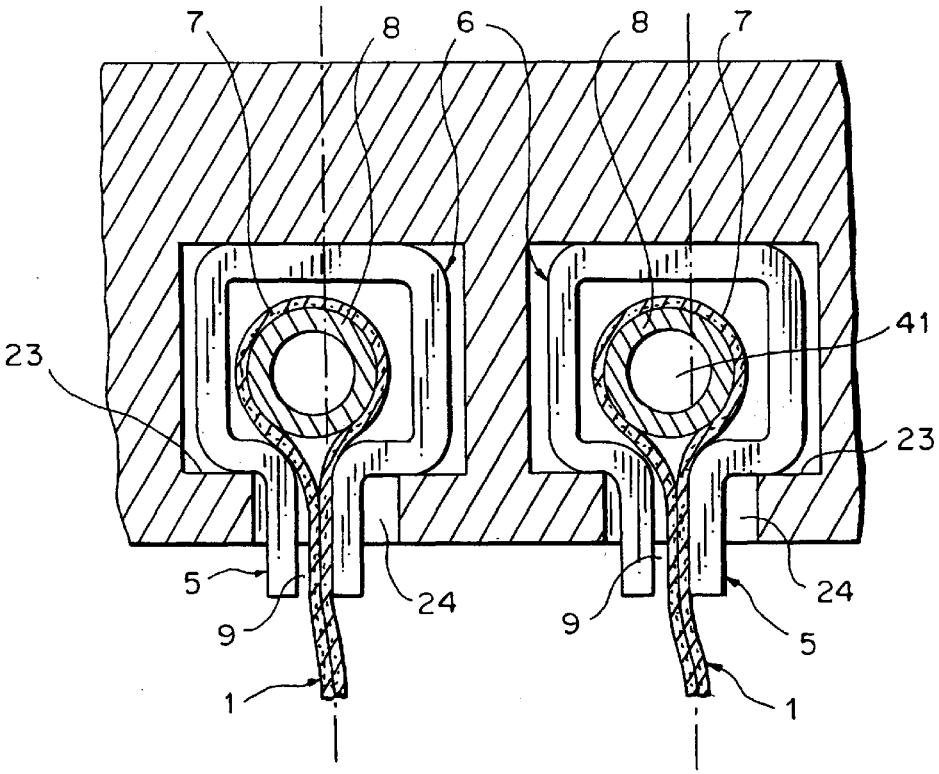
FIG. 6 is a section similar to that of FIG. 5, but on a large scale, showing certain parts in more detail of FIG. 5 in a rest position.
Figure 10:
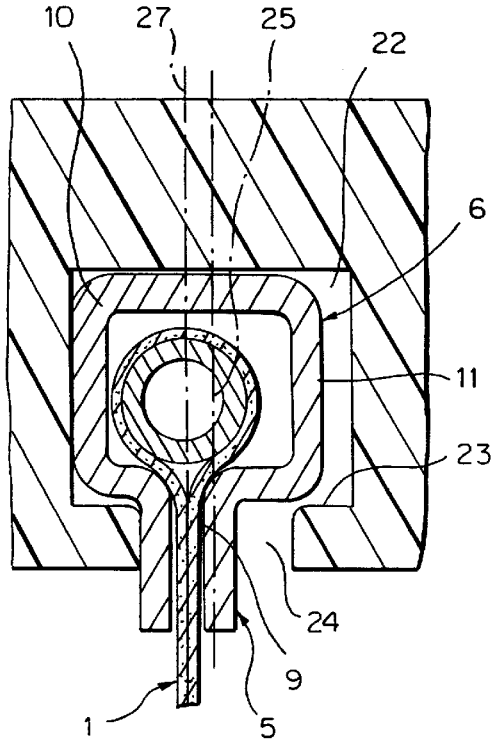
FIG. 10 is, on a larger scale, a section similar to that of FIG. 6 showing the position of the lateral edge of the screen in the spiral guide channel during the unrolling of the screen.
Figure 11:
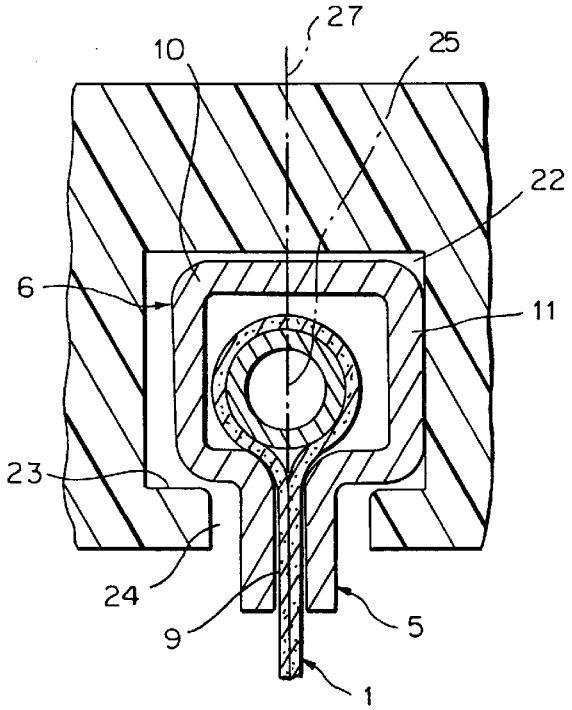
FIG. 11 is similar to FIG. 10, but shows the position of the lateral edge of the screen in the spiral guide channels during roll up of the screen.
Figure 8:
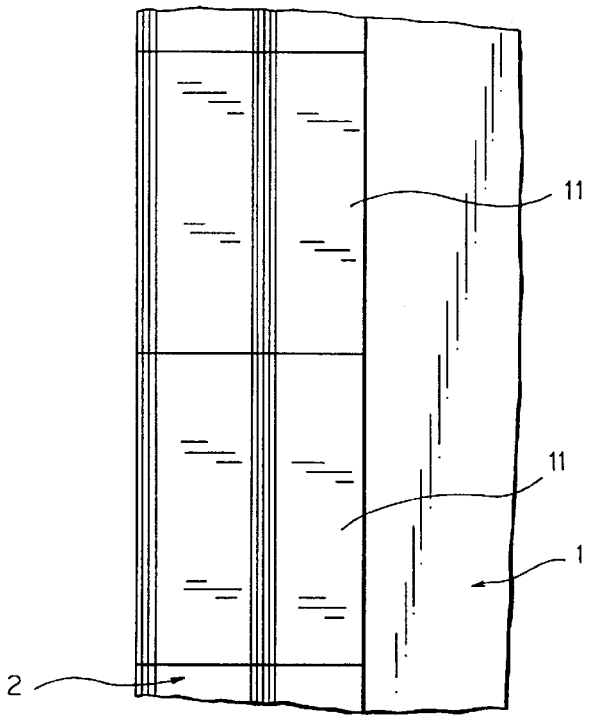
FIG. 8 is a view from one side of a detail of this first embodiment on a larger scale.
Figure 9:
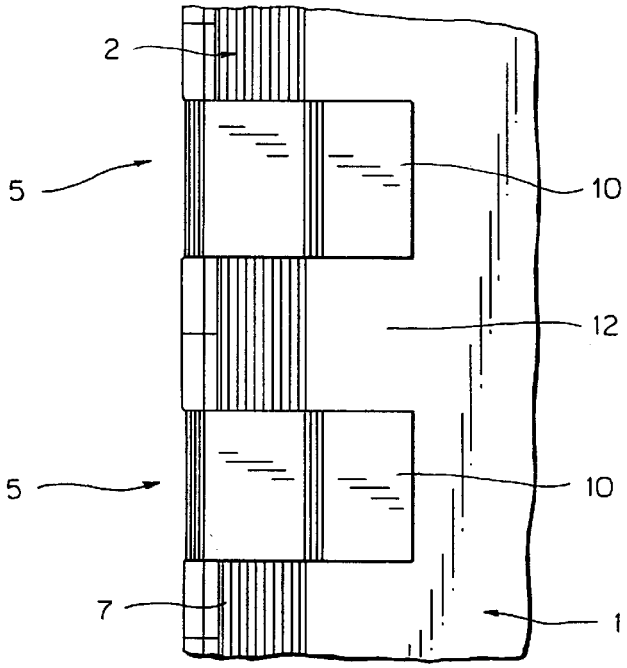
FIG. 9 is a view similar to that of FIG. 8, but from the opposite side of this same detail.

As one can see in FIGS. 6, 10 and 11, the sleeves 6 have a rectangular cross-section and are fitted with a certain transverse play with respect to the screen 1 in the guide channels 18. Thus, a certain translation movement of the edges 2 of the screen is possible in the plane of the flanges or cheeks 40.

Furthermore, as a result of the rectangular shape of the cross-section of the protrusion 6 and of the corresponding shape of the inside of the guide channels 18, the angular movement of the rigid link members 5 inside these guide channels is very small and comprises at most 10° about the central axis 25 of the channels (see FIG. 10).

Moreover, the radial distance between the turns of the guide channels 18 is such that, in the rolled up position, the superimposed layers of the rolled up screen do not touch each other, as shown clearly in FIGS. 4 to 7. Furthermore, it may be important to stretch the screen 1 between the flanges or cheeks 40. An important advantage of this is that the windows 38 are prevented from being scratched during the rolling up of the screen.

As shown in FIGS. 10 and 11, the spiral guide channels 18 delimit a substantially tubular channel 22, preferably of polygonal cross-section, with a wall 23, and on the side towards the screen 1, a longitudinal slot 24 for the passage of screen 1.

The central spiral axis 25 of the channel 22 is located in the plane of symmetry of the slot 24, whilst the screen extends in the plane 27.

FIG. 10 shows the position of the rigid link members 5 in the guide channels 18 during the unrolling of the screen towards its closed position. The center of curvature, which is located on the axis 17, is in this case on the right hand side of FIG. 10. Thus, the lateral edges 2 of the screen 1 are applied against the outer surface of the guide channels with respect to this center of curvature.

Conversely, during the rolling up of the screen 1, the rigid link members 5 undergo a movement in the opposite direction, as shown in FIG. 11. In this case, the lateral edges 2 of the screen 1 are therefore applied against the inner surface of the guide channels 18, on the side near the previously mentioned center of curvature.

These different arrangements of the rigid members 5 make it possible to prevent the latter from being moved over the lateral edges 2 of the screen 1 during its rolling up and unrolling.

As shown in FIGS. 4 and 5, when, in the open position, the screen is rolled up as a spiral. The driving means 4 which is located in the vicinity of the flanges or cheeks 40 inside the box 39, and comprises telescopic arm 19 working in conjunction with the upper end of the lateral edges of the screen 1.

This telescopic arm 19 is mounted transversely on a drive shaft 20 extending along the previously mentioned axis 17 and is fixed to a bar 21 parallel to this shaft 20. This bar works in conjunction with the end of the lateral edges 2 of the screen, which are engaged in the spiral guide channels 18 through a connecting part 35 fixed to the transverse edge 41 of the screen 1 and slid in longitudinal groove 42 of this bar 21.

More precisely, the telescopic arm 19 comprises two parallel U-shaped guide parts 43, fixed on either side of the shaft 20, in which are slid square cross-section tubes 44, one of the ends of which is rendered integral with the bar 21, which also consists of a square tube.

Thus, in order to move the screen 1 in the direction of the arrow 45, that is to say in order to bring the screen into its closed position, the shaft 20 is rotated in the direction of the arrow 46 by the motor 36 and the connecting part 35 pushes on the lateral edge 2 in its lengthwise direction, whilst the tubes 44 undergo a movement in the direction of the arrow 47. If necessary, the connecting part 35 can slide along the groove 42 of the bar 21 during the unrolling of the screen.

The opening of the screen can be caused either by the spring 31, as already described above, or by driving the shaft 20 in the direction opposite to the arrow 46.

Figure 12:
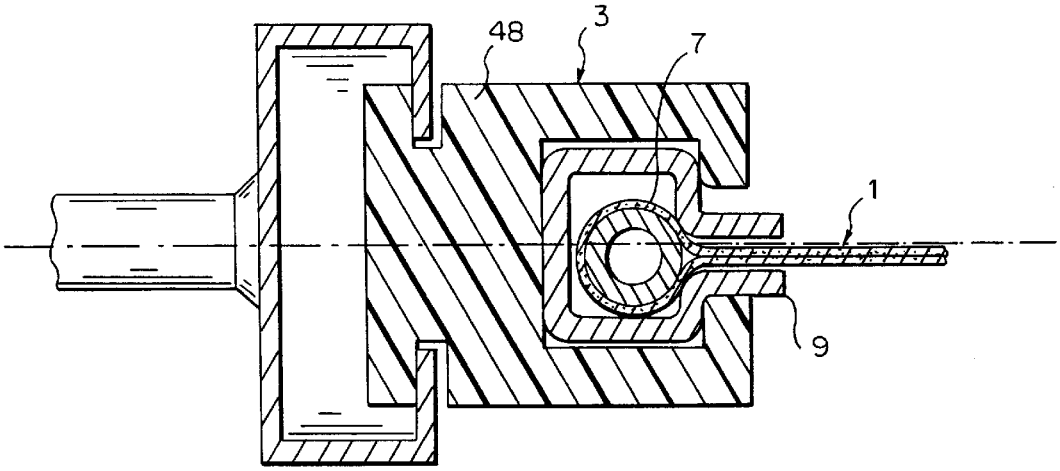
FIG. 12 is a cross-section, and on a larger scale, along the line XII—XII of FIG. 1.
Figure 13:
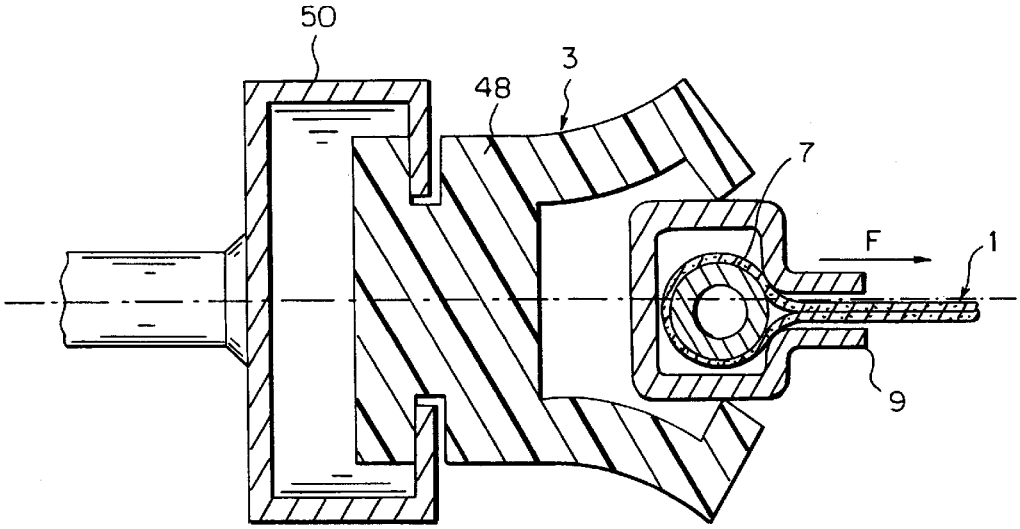
FIG. 13 is a view similar to that of FIG. 12 showing the disengagement of the lateral edge of the screen from the guide channels when a force is applied to the screen in the direction of the arrow F.

Advantageously, as shown in more detail in FIGS. 12 and 13, the straight guide channels 3 comprise a U-shaped profile 48 made from a semi-elastic material, to allow that when a traction force is applied to the screen 1 in the direction of the arrow F exceeding a certain limit, the lateral edges 2 of the screen can be disengaged from the guide channels 3. Such a force could for example result from the fact that a vehicle catches onto the screen 1 whilst the latter is still in its closed position.

Opposite the upper end of each of the guide channels an access passage 49 is located at the entrance of the box 39. When a lateral edge 2 is disengaged from its guide channel 3, as shown in FIG. 13, while screen 1 is moving in a direction opposite to the arrow 45, the edges of the screens automatically re-engage through access passages 49 into their guide channels, at the entrance of the retainer box 39 (see FIG. 4).

The base of the U-shaped profile 48 is held in a metal support 50 also having a U-shaped cross-section.

These supports 50 are advantageously mounted on elastic elements which are not shown. Such an assembly systems was the subject of European patent No. 92909384 of the same applicant.

Figure 14:
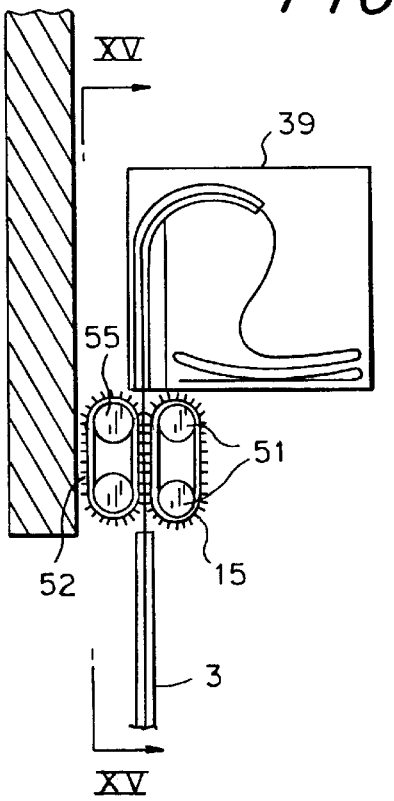
FIG. 14 is a diagrammatic side view and a section of a closing device according to a second embodiment of the invention with the screen in a partially closed position and a cheek of one end of the retaining box removed.
Figure 15:
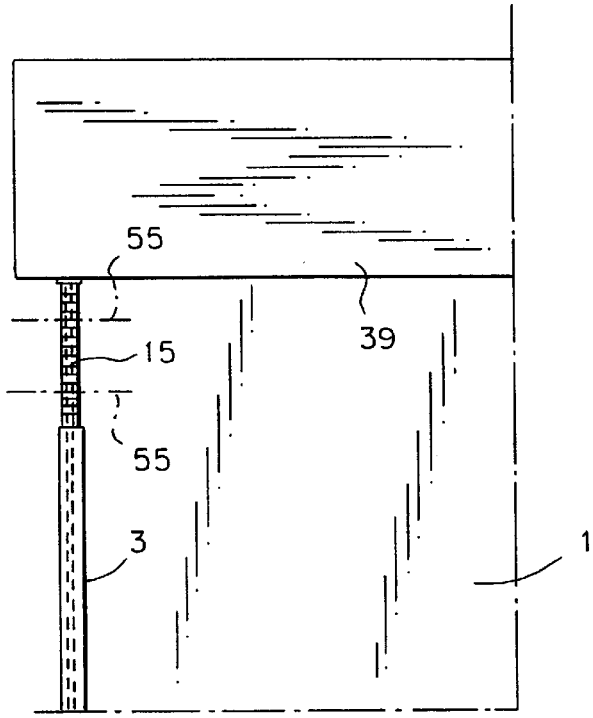
FIG. 15 is a diagrammatic front view along the line XV—XV of FIG. 14.

FIGS. 14 and 15, show, very diagrammatically, a second embodiment of the closing device according to the invention.

In this embodiment the lateral edges 2 have the appearance of an articulated chain moving in the guide channels 3.

The straight guide channel 3 is interrupted before the entrance of the box 40 and, at this place of interruption, on either side of the lateral edge 2, driving means 4' are provided. These driving means 4 comprise two pairs of toothed wheels 51 over which moves an endless belt 52 externally provided with teeth able to engage in the link of the articulated chain 15.

For the sake of clarity, in FIG. 15 only the axes of rotation 55 of the toothed wheels 51 are represented.

Another difference of this second embodiment with respect to the first one is that, inside the box 39, the screen is folded in zig-zag formation when it.

Figure 16:
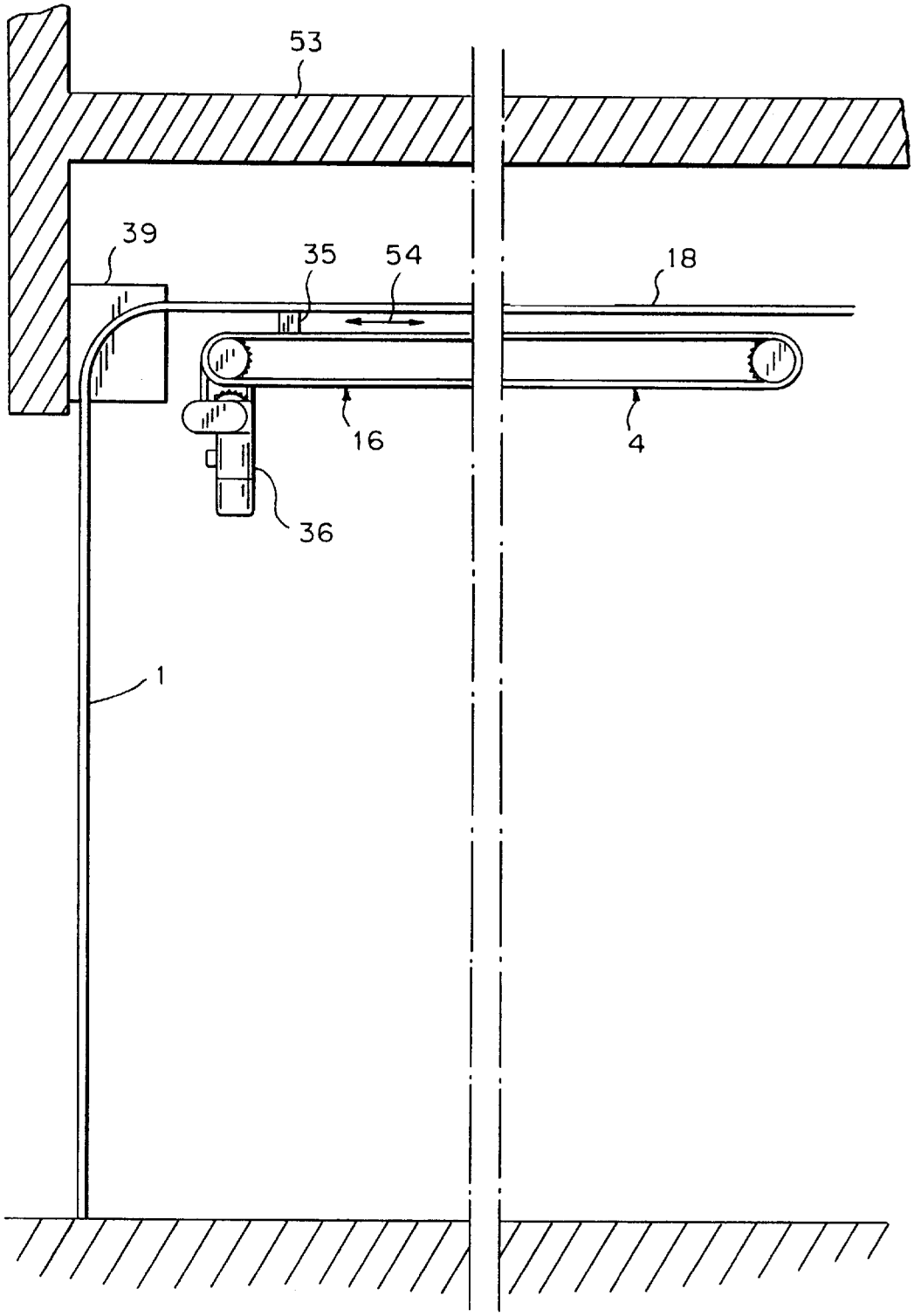
FIG. 16 is a diagrammatic sectional side view, with a partial break, of a third embodiment of the closing device according to the invention with the screen in the closed position.

FIG. 16, wherein again like elements are numbered as in the preceding embodiments, is a simplified representation of a third embodiment of the closing device according to the invention.

In this embodiment, the screen 1 is brought into a horizontal open position, being guided along a ceiling 53 in guide channels 18", after having undergone a 90° deflection. Furthermore, the driving means 4" comprise and endless chain transmission 16 able to move along the horizontal section of the guide channels 18" with a backward and forward motion, as indicated by the arrows 54. A connection piece 35 is provided between the upper end of the lateral edges 2 of the screen 1 and the chain 16, thus making it possible to move the screen between its open position and its closed position during the movement of the chain 16.

In an interesting variant of this embodiment, the chain 16 can be fixed to the upper end of the lateral edges 2 and can also be guided in the guide channels 18" in such a way that can be pushed on this end, in the axis of these edges 2, in order to bring the screen into its closed position.

Figure 17:
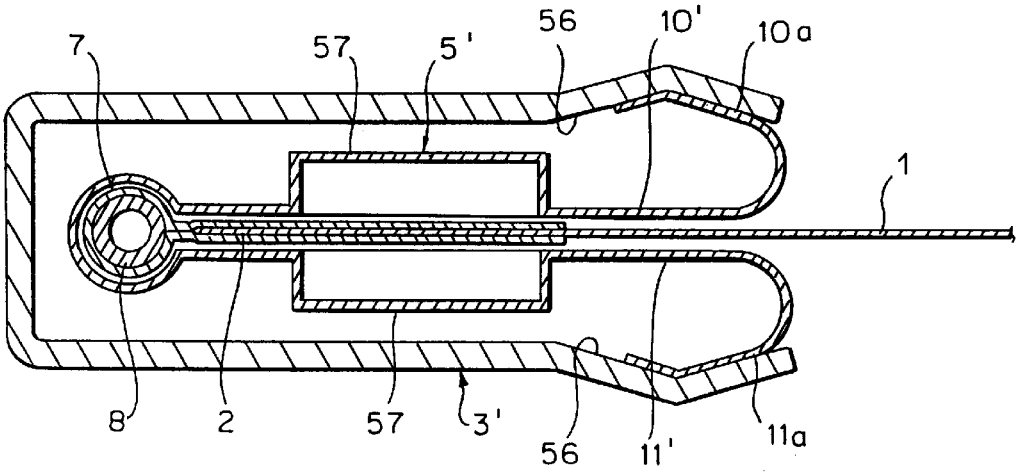
FIG. 17 is a similar section to that of FIG. 12 of a fourth embodiment of the invention.
Figure 18:
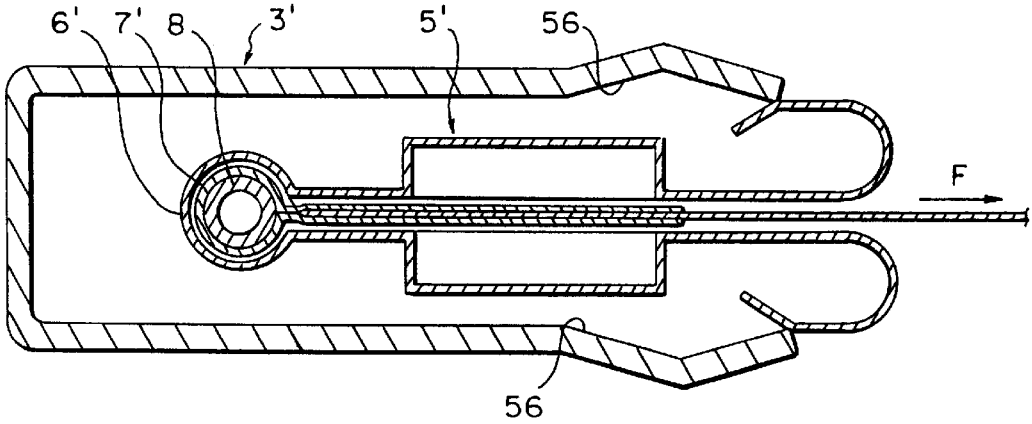
FIG. 18 is a similar view to that of FIG. 13 of this fourth embodiment.

FIGS. 17 and 18 show a fourth embodiment of a closing device according to the invention which differs from the preceding embodiments as a result of the straight guide channels 3' and the rigid members 5'.

In this fourth embodiment, the rigid members are formed by clips, preferably metallic, having the shape of a U in which the free ends of the flanges 10' and 11' form sections curved towards the exterior 10*a* and 11*a* which are, as shown in FIG. 17, fitted into an internal hollow 56 formed near the outer edge of the guide channels 3'.

Furthermore, these members 5' have, between these curved sections 10*a* and 11*a* and their protruding end 6', clamped around the bead 7' of the screen 1', a stamped part 57 serving as a support for the various members 5' against one another on the lateral edges 2 of the screen, inside the guide channels 3'.

When a traction force, in the direction of the arrow F, is applied to the screen 1, the lateral edges 2 can disengage from their guide channels 3' due to the fact that the curved sections 10*a* and 11*a* elastically bend towards the inside, as shown in FIG. 18.

Figure 19:
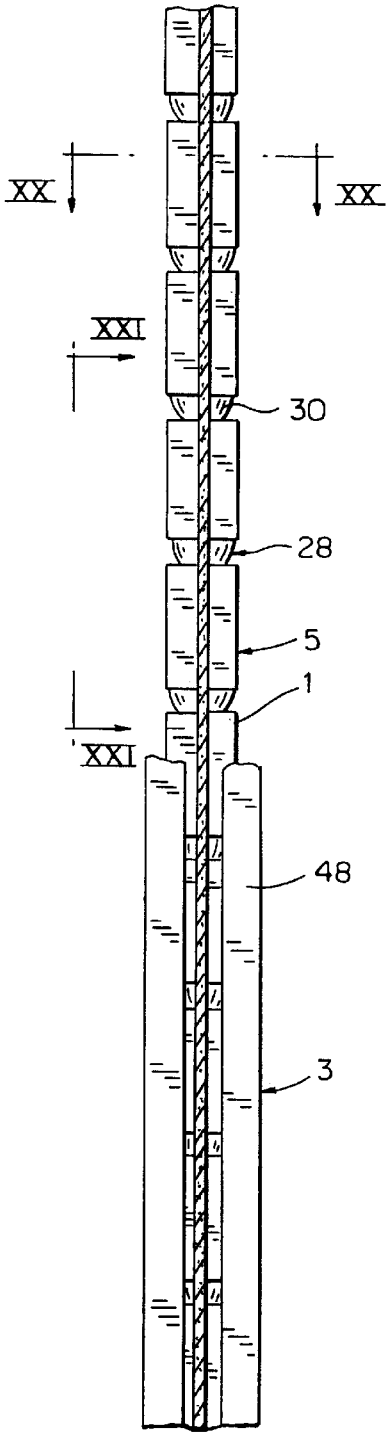
FIG. 19 is, on a larger scale, a longitudinal section with partial breaks, similar to that along the line XIX—XIX of FIG. 1, but of a fifth embodiment of the invention.
Figure 20:
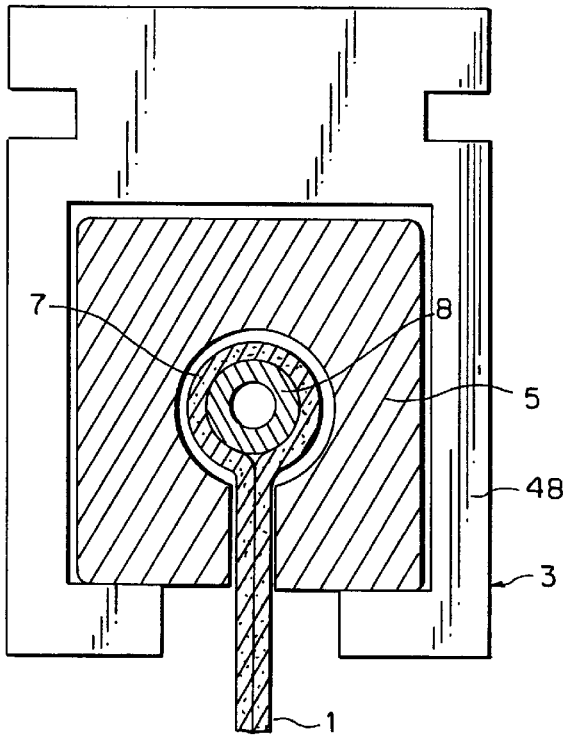
FIG. 20 is, on a larger scale, a section along the line XX—XX of FIG. 19.
Figure 21:
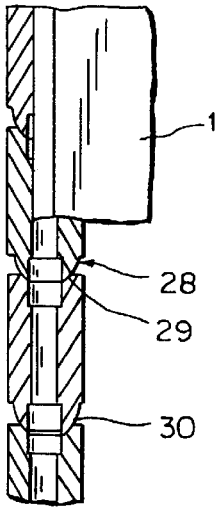
FIG. 21 is, with partial breaks, a section along the line XXI—XXI of FIG. 19.

FIGS. 19, 20 and 21 relate to a particularly interesting fifth embodiment of the invention, which differs basically from the preceding embodiments by the fact that the rigid members 5", fixed to the lateral edges 2 of the screen 1, work in conjunction with channel 3 and with one other by the intermediary of a ball-joint coupling 28.

In this particular embodiment this ball-joint coupling comprises a spherical seating 29 at one of the ends of the rigid member 5' and a pivot with a spherical head 30 at the opposite end of this rigid member 5". The head of the pivot 30 of the rigid member is articulated in the seating 29 of the following antecedent rigid member, as shown clearly in FIG. 21.

Furthermore, as well the seating 29 as the pivot 30 are split in the lengthwise direction of the edges 2. Thus, by pressing the pivot 30 in its corresponding seating 29, the pivot is lightly compresses whilst the seating can undergo a certain expansion, in order to ensure a reliable fixing of two successive rigid members with respect to one other, whilst allowing to articulate the latter in all directions. The nature of this compression and this expansion depends of course on the materials of which the member 5" is made.

When the lateral edges 2 of the screen 1 are provided with a bead 7, as is the case in the present embodiment, the rigid members 5" extend as well together with their pivot 30 as with their corresponding seating 29, around the bead 7, as shown clearly in FIG. 20.

Figure 22:
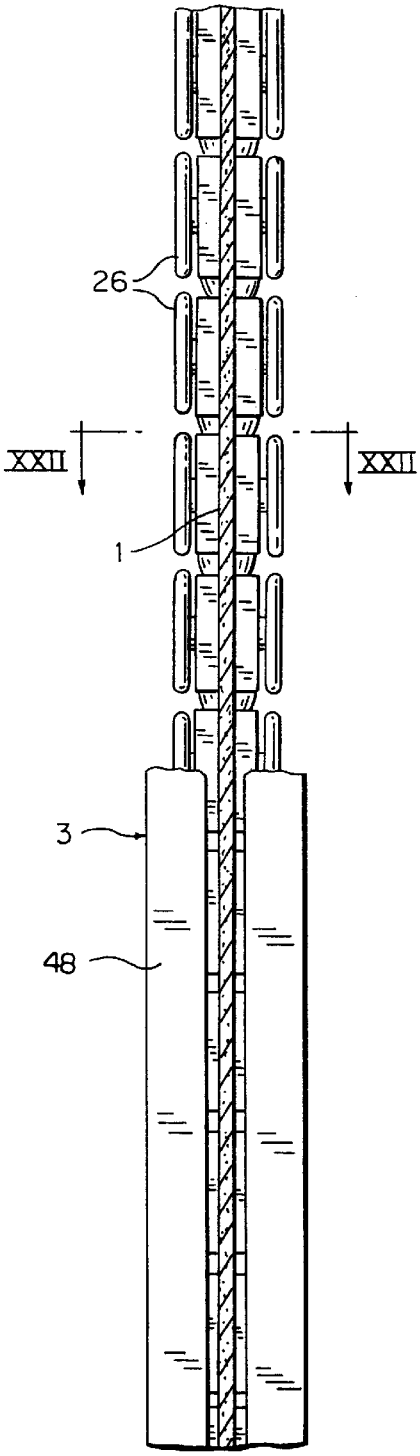
FIG. 22 is a similar view to that of FIG. 19 of a sixth embodiment of the invention.
Figure 23:
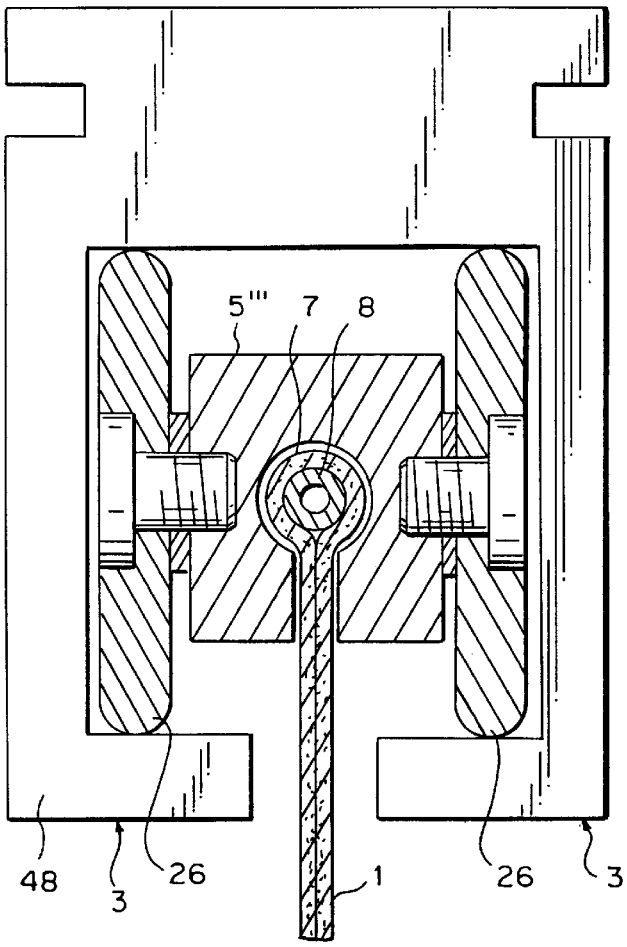
FIG. 23 is, on an even larger scale, a section along the line XXIII—XXIII of FIG. 22.

FIGS. 22 and 23 relate to a sixth embodiment of the closing device, according to the invention, which basically differs from the preceding embodiment by the fact that each rigid member 5"' is provided with two rollers 26, thus making it possible to reduce considerably the friction of the lateral edges 2 during their movement in the guide channels 3.

Figure 24:
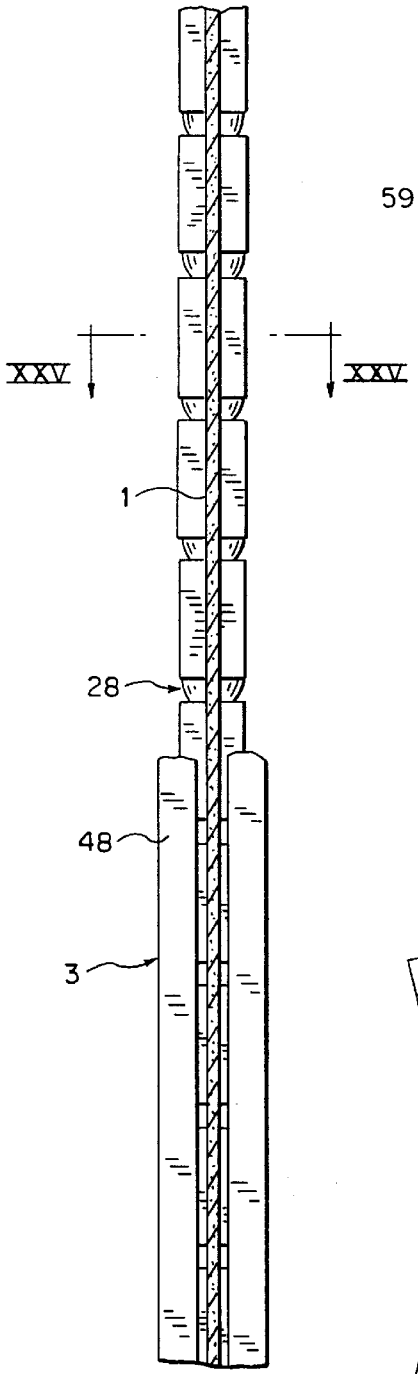
FIG. 24 is a similar view to that of FIG. 19 of a seventh embodiment of the invention.
Figure 25:
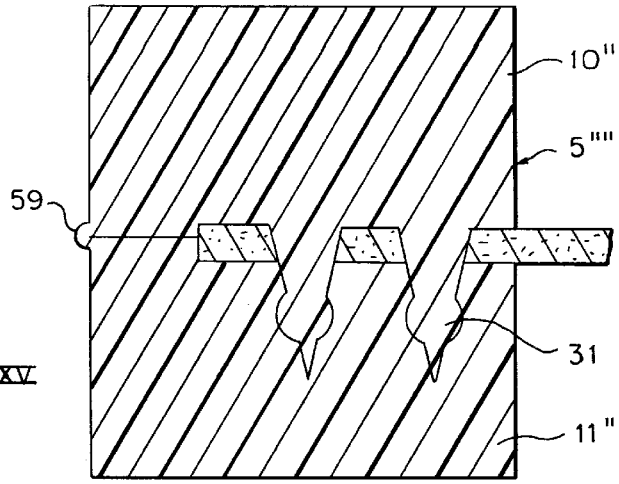
FIG. 25 is, on a larger scale, a section along the line XXV—XXV of FIG. 24.
Figure 26:
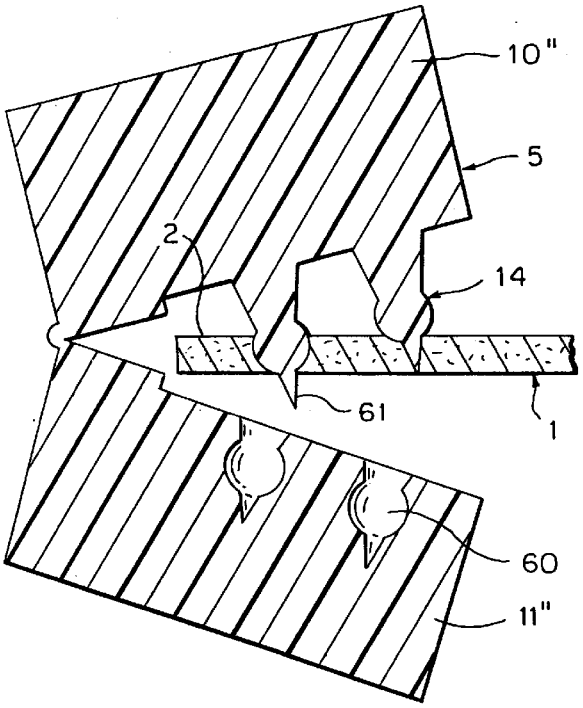
FIG. 26 is a similar section to that of FIG. 25 during assembly.

FIGS. 24 to 26 relate to a seventh embodiment of the invention relatively simple with regard to the fixing of the rigid members to the lateral edges 2 of the screen.

This embodiment basically differs from the preceding embodiments by the fact that no special finishing is provided on the lateral edges 2. For example, unlike the case in practically all the preceding embodiments, a bead is not provided.

Moreover, in this embodiment, the rigid members 5"" with ball-joint coupling 28 are formed from two flanges 10" and 11" articulated with each other at 59. As shown clearly in FIGS. 25 and 26, these two flanges are fixed rigidly on either side of the lateral edges 2 of the screen. for this purpose, the surface of the flange 10" facing the flange 11" is provided with pins 14 which pierce the lateral edges 2 of the screen 1 to penetrate into and become fixed in corresponding holes 60 provided in the facing surface of the flange 11.

These members 5"" may, for example, be made from a plastic material which is relatively hard, but being elastic enough to allow the pins 14 to be fixed elastically into the holes 16. If necessary, the points 61 of the pins 15 may be provided with a metal cap, which is not shown, to facilitate the piercing of the lateral edges of the screen 1.

Figure 27:
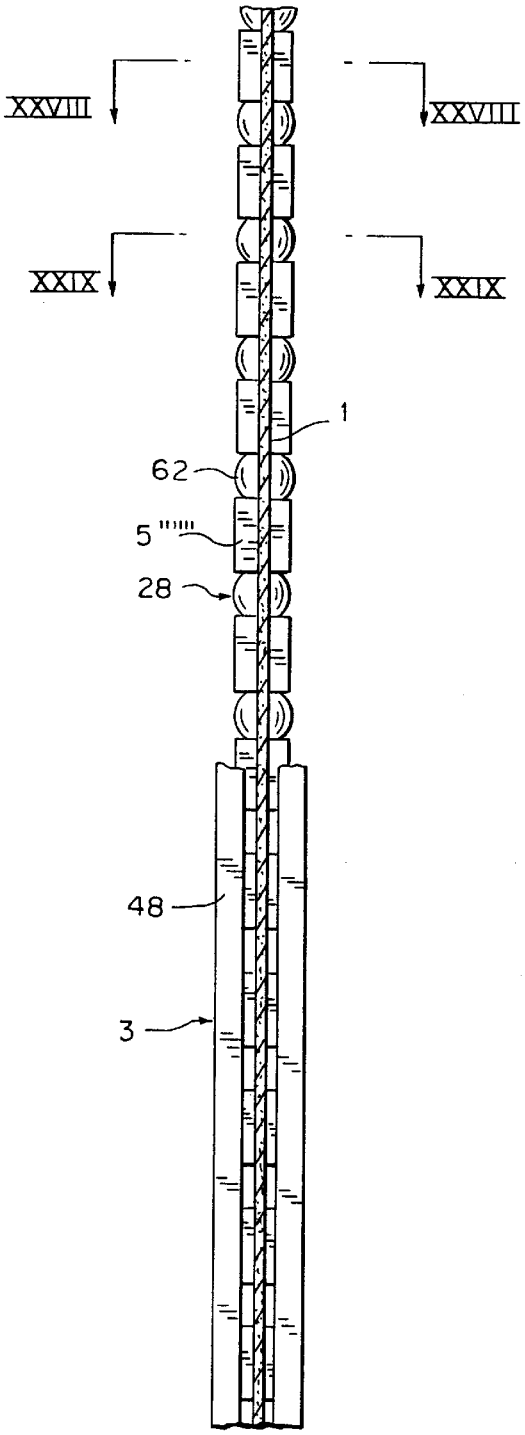
FIG. 27 is a similar view to that of FIG. 22 of an eighth embodiment of the invention.
Figure 28:
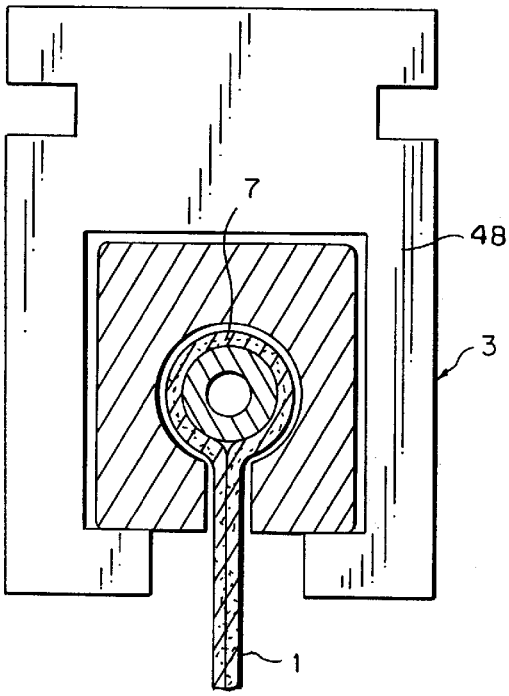
FIG. 28 is, on a larger scale, a section along the line XXVIII—XXVIII of FIG. 27.
Figure 29:
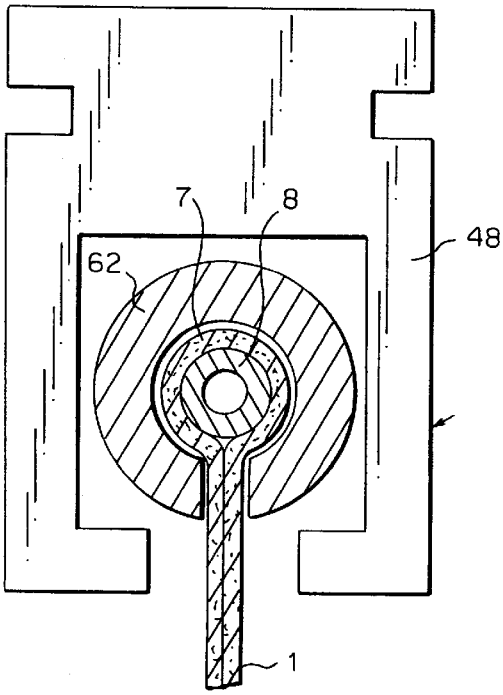
FIG. 29 is, on the same scale as FIG. 28, a section along the line XXIX—XXIX of FIG. 27.

FIGS. 27 to 29 relate to an eighth embodiment which differs from that in FIGS. 19 to 21 by the fact that the ball-joint coupling comprises, between each rigid member 5""", a split ball 62 partially engaging in a corresponding seating 29 provided at the two opposite ends of each rigid member 5""". These are seatings similar to those provided in the embodiment shown in FIGS. 19 to 21.

FIGS. 30 to 32 relate to a ninth embodiment of the closing device according to the invention.

This embodiment basically differs from the preceding embodiments in that use is made of a screen 1, of which the lateral edges 2 are not necessarily incompressible in themselves in their longitudinal direction, but are rendered incompressible indirectly by the presence of a stiffening zone 1' which extends in the vicinity of these lateral edges 2, outside of the guide channels 3.

This has, in particular, the advantage that special precautions do not have to be taken in the making of these lateral edges 2 and that one can, for example, make us of lateral edges formed by a simple bead or by a series of small rigid juxtaposed blocks articulated with respect to each other, as for example described and shown in European Patent 272, 733.

Thus, in general, the phrase "lateral edge rendered incompressible" used in the present text denotes any type of lateral edge which, combined with a stiffening zone, located either outside the guide channels or inside the latter, makes it possible to prevent that, when a thrust is applied to this edge or to this stiffening zone 1' in the direction of closing the screen, this edge can deform and jam in these guide channels or create excessive friction forces which would jeopardize the correct functioning of entire closing device.

In more concrete terms, in this ninth embodiment, the above-mentioned stiffening zone 1' is formed by a notched belt fixed to the screen 1, whilst the driving means comprise a notched pulley 51' rotating about an axis 51' and engaging with the notched belt 1'. A pressure roller 51''' is applied elastically against the screen 1 on the side opposite the latter with respect to the notched belt 1', in such a way as to ensure perfect engagement between the latter 1' and the pulley 4.

With regard to the lateral edge 2, the latter is formed by the small blocks of one of the parts of a known zip fastener which therefore has a certain compressibility in itself in its longitudinal direction, but which is rendered substantially incompressible, within the meaning given above.

As a variant of this ninth embodiment, it is possible to envisage replacing the small blocks of a zip fastener in the lateral edges for example with a notched belt which would therefore be simultaneously a part of the driving means and of the lateral edge 2 itself of the screen 1 moving in the guide channels 3.

Figure 33:
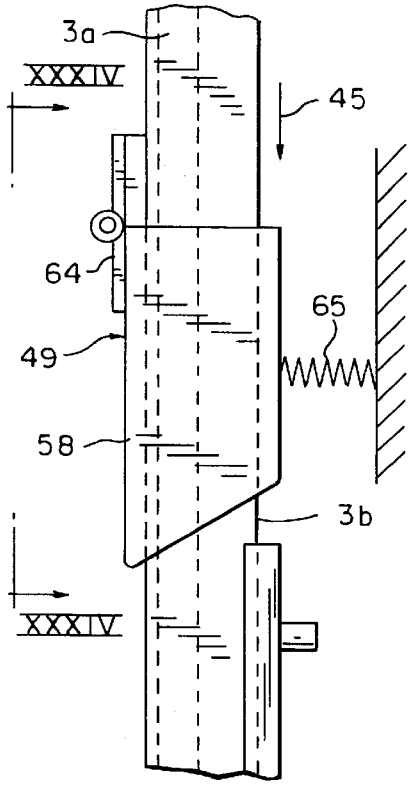
FIG. 33 is a diagrammatic side view, with partial breaks, of an additional variant of the details of the guide channel for the lateral edges of the screen.
Figure 35:
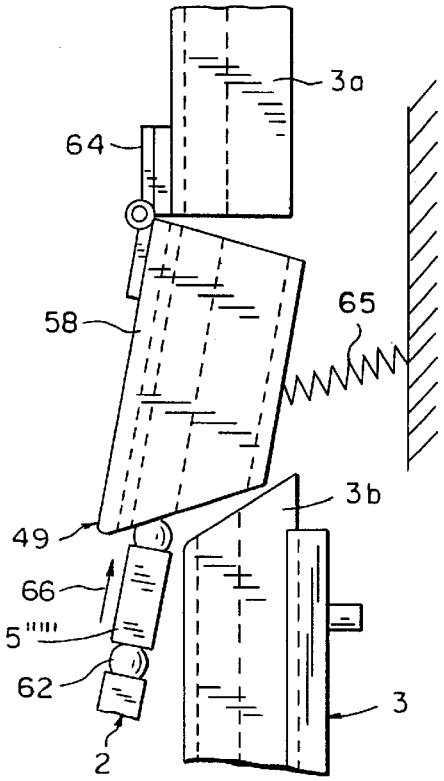
FIG. 35 is a view similar to that of FIG. 33, but in a position for the re-engagement of a lateral edge of the screen in the guide channel.
Figure 34:
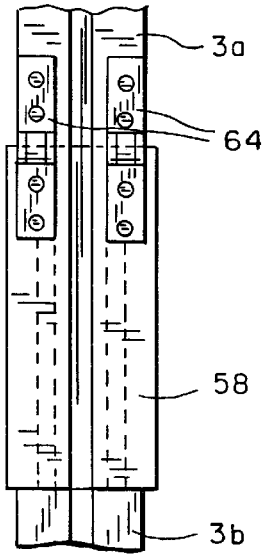
FIG. 34 is a front view along the line XXXIV—XXXIV of FIG. 33.

FIGS. 33 to 35 relate to an improvement applied to the access passage 49 for the automatic reinsertion of a lateral edge 2 of the screen 1 which has become disengaged from the lower section of the guide channels 3 (See FIG. 4 on this matter).

It concerns an improvement which is particularly useful for the lateral edges of screens according to the embodiments shown in FIGS. 19 to 32.

Indeed, in certain cases, if in the access passage 49 the lateral edges 2 are not supported when the latter are pushed towards the closed position, that is to say in the direction of the arrow 45, as is the case in the embodiment shown in FIG. 4, as a result of the friction of these edges in the guide channels, there is a risk that these edges will undergo a slight flexion at the position of the access passage 49 causing them to come out of the guide channels 3.

The improvement, according to the invention, consists in interposing, in the access passage 49, between the two separate fixed portions 3*a* and 3*b* of the guide channels extending in the prolongation of one another a mobile guidance connector 58, which is articulated at its upper edge, by the intermediary of hinges 64, with the portion 3*a* of the guide channels 3, in such a way as to be able to pivot between a first position, in which this connector 58 extends in the prolongation of the portions 3*a* and 3*b* of the guide channels, as shown in FIG. 30, and a second position, in which its lower opening is directed outside of the guide channels 3, as shown in FIG. 35.

A spring 65 makes it possible to retain the connector in or to return it to the said first position.

Thus, when, for any reason, the lateral edges 2 of the screen 1 are disengaged from the portion 3*b* of the guide channels during the movement of the screen towards its open position, as indicated by the arrow 66 in FIG. 35, the connector 58 will automatically be brought into the said second position in order to thus allow the reinsertion of this edge 2 into portion 3*a* of the guide channel 3.

When the lower transverse edge of the screen and of these lateral edges 2 arrive at the position of the connector 58, or eventually above the latter, it automatically takes up its initial position again, as shown in FIG. 33. In order to then bring the screen into its closed position, these lateral edges will be perfectly guided over the whole length of the guide channels, thus avoiding any risk of obstruction or disengagement of these edges at the position of the access passage 49.

In order to ensure perfect continuity in the guide channels and the connector 58, in its first position, the latter has advantageously an internal cross-section identical to that of the fixed portions 3*a* and 3*b* of the guide channels in order to form an entirely continuous guide channel.

It should also be noted that in FIGS. 33 and 34, the lateral edges 2 of the screen 1 have not been shown so that it can be assumed that the screen is in its open position. Conversely, in FIG. 35, the representation of a lateral edge is restricted to the showing of rigid members 5'''' cooperating with each other by the intermediary of balls 62, as in the lateral edges of the embodiment shown in FIGS. 27 to 29.

An interesting variant of the closing device according to the invention consists in providing, by way of means which make it possible to prevent the compression of the lateral edges 2 of the screen 1 in their lengthwise direction at least during the movement of the latter towards its closed position, a driving mechanism comprising for example a cable and return pulleys applying traction on these lateral edges in order to cause the closing of the screen. In this variant, it is not necessarily that the lateral edges 2 are incompressible or rendered incompressible in their lengthwise direction.

Furthermore, in this variant, the screen is stretched between the guide channels 3, in which these edges move, at least when it is in its closed position.

This has the big advantage that, in this way, it is also possible to avoid the use of a stiffening element, for example in the form of a rigid bar, near the lower free edge of the screen 1. In this case, the screen should preferably be entirely flexible, without any traverse stiffening element.

It goes without saying that the invention is not limited to the various embodiments described above and shown in the accompanying figures, but that many other variants may still be envisaged without moving beyond the scope of the present invention.

Thus, the lateral edges 2 of the screen 1 could be rendered substantially incompressible in their lengthwise direction by providing, near these edges, a series of rigid plates fixed to the screen and located outside the guide channels or by fixing to the screen 1 a strip of reinforced fabric in the direction of movement of the screen, thus preventing, in this zone and therefore also at the lateral edges, the screen from puckering, when a thrust force is applied, in the direction of closing the screen, either directly on the lateral edges or on this reinforced strip. In this case, the lateral edges may simply be formed by the bead 7, for example.

In still other cases, the lateral edges could be rendered substantially incompressible in their lengthwise direction by introducing in the latter a series of balls somewhat like the balls 62 of the embodiment shown in FIGS. 27 to 29. If necessary, these balls could be inserted in the hollow pipe 8, which would form a cover for these balls and which, in this case, would have a cross-section a little larger than that of the embodiments shown in the accompanying figures.

Another variant could consist in providing small rigid blocks, which would for example be moulded on the lateral edges of the screen, for example like the teeth of a zip fastener, between which there would be a flexible but incompressible seal.

Furthermore, it is not essential that the shaft 20 should extend over the entire length of the screen. In an extreme case, this shaft may be formed by two coaxial sections in the vicinity of the lateral edges of the screen for driving the telescopic arm 19. Also, if other driving means are used, which do not necessitate such a shaft 20, as for example in the case in the embodiments shown in FIGS. 14 to 16, such a shaft could be omitted.

Furthermore, in the absence of a drive shaft, the screen does not necessarily have to roll up but may, for example, move in any slanted, horizontal or vertical plane from its closed position towards its open position.

If the screen moves between its open position and its closed position in the same plane, the lateral edges do not necessarily have to be flexible.

The invention is also not limited to screen which move in a vertical plane, but also relates to screens moving horizontally, for example in order to cover swimming pools or silos.

In certain cases, the rolling up of the screen may be carried out from the lower edge, thus contrary to the embodiments shown in the accompanying figures.

I claim:

1. A closing device comprising a flexible screen (1) having lateral edges (2) guided in guide channels (3) to permit the screen (1) to be moveable between a closed position and an open position, wherein said edges (2) are substantially incompressible in a direction of movement of the screen towards the closed position in a longitudinal direction of said edges, and driving means for applying a thrust force on the lateral edges (2) in the longitudinal direction of the edges when in the guide channels (3) to move the screen towards the closed position;

wherein the screen (1) is provided, at the lateral edges (2), with a series of separate substantially rigid link members which are incompressible along the longitudinal direction of the lateral edges (2), the rigid link members being able to bear against one another, in the longitudinal direction of the lateral edges (2), and the rigid link members being articulated with respect to each other in order to allow the screen (1) to be moved to an open position;

wherein the rigid link members surround at least partially the lateral edges (2) of the screen (1), forming a protrusion with respect to a surface of the lateral edges (2) the protrusion being moveably held in the guide channels (3);

wherein the lateral edges (2) of the screen (1) have a substantially continuous bead (7) around which are fixed the rigid link members; and wherein the continuous bead (7) of the lateral edges (2) encloses a hollow pipe (8) containing a fluid.

2. A closing device comprising a flexible screen (1) having lateral edges (2) guided in guide channels (3) to permit the screen (1) to be moveable between a closed position and an open position, wherein said edges (2) are substantially incompressible in a direction of movement of the screen towards the closed position in a longitudinal direction of said edges, and driving means for applying a thrust force on the lateral edges (2) in the longitudinal direction of the edges when in the guide channels (3) to move the screen towards the closed position;

wherein the screen (1) is provided, at the lateral edges (2), with a series of separate substantially rigid link members which are incompressible along the longitudinal direction of the lateral edges (2), the rigid link members being able to bear against one another, in the longitudinal direction of the lateral edges (2), and the rigid link members being articulated with respect to each other in order to allow the screen (1) to be moved to an open position;

wherein when the screen (1) is in an open position the screen is rolled up around an axis (17), and the guide channels extend around the axis (17) in a spiral (18) in a plane perpendicular to the axis, wherein in the open position, the lateral edges (2) of the screen (1) are held in the spiral guide channels (18); and wherein the rigid link members are fitted in the spiral guide channels (18) so that they can undergo an angular movement of at most 10° about a central axis (25) of the spiral guide channels during their movement along the central axis.

3. A closing device comprising a flexible screen (1) having lateral edges (2) guided in guide channels (3) to permit the screen (1) to be moveable between a closed position and an open position, wherein said edges (2) are substantially incompressible in a direction of movement of the screen towards the closed position in a longitudinal direction of said edges, and driving means for applying a thrust force on the lateral edges (2) in the longitudinal direction of the edges when in the guide channels (3) to move the screen towards the closed position;

wherein the screen (1) is provided, at the lateral edges (2), with a series of separate substantially rigid link members which are incompressible along the longitudinal direction of the lateral edges (2), the rigid link members being able to bear against one another, in the longitudinal direction of the lateral edges (2), and the rigid link members being articulated with respect to each other in order to allow the screen (1) to be moved to an open position;

wherein when the screen (1) is in an open position the screen is rolled up around an axis (17), and the guide channels extend around the axis (17) in a spiral (18) in a plane perpendicular to the axis, wherein in the open position, the lateral edges (2) of the screen (1) are held in the spiral guide channels (18);

wherein a radial distance between turns of the spiral guide channels (18), is such that, in the rolled up position, superimposed layers of the screen do not touch each other; and wherein the driving means comprises at least one telescopic arm (19) cooperating with an end of the lateral edges (2) of the screen (91) on a side of the axis (17).

4. A device according to claim 3, wherein the telescopic arm (19) is mounted transversely on a drive shaft (20) extending along axis (17) and is fixed to a bar (21) parallel with the shaft (20), the shaft (20) cooperating with the lateral edges (2) of the screen (1) engaged in the spiral guide channels (18) by an intermediary connecting part (35) fixed to the screen (1) and, sliding with respect to the bar (21).

5. A closing device comprising a flexible screen (1) having lateral edges (2) guided in guide channels (3) to permit the screen (1) to be moveable between a closed position and an open position, wherein said edges (2) are substantially incompressible in a direction of movement of the screen towards the closed position in a longitudinal direction of said edges, and driving means for applying a thrust force on the lateral edges (2) in the longitudinal direction of the edges when in the guide channels (3) to move the screen towards the closed position;

wherein the screen (1) is provided, at the lateral edges (2), with a series of separate substantially rigid link members which are incompressible along the longitudinal direction of the lateral edges (2), the rigid link members being able to bear against one another, in the longitudinal direction of the lateral edges (2), and the rigid link members being articulated with respect to each other in order to allow the screen (1) to be moved to an open position;

wherein the guide channels (3) further comprise two fixed portions (3*a*) and (3*b*) which prolong one another, a mobile guide connector (58) being interposed between the two fixed portions and being articulated on an edge of one openings with the portion (3*a*) located towards the open position of the screen, in order to pivot between a first position, in which the connector (58) extends in the prolongation of the two fixed portions (3*a*) and (3*b*) and a second position, in which the connector is orientated by an opposite opening outside the guide channels in order to allow reinsertion during the movement of the screen towards open position of the lateral edges (2) of the screen (1) when disengaged from a first portion (3*b*) of said two fixed portions, means (65) being provided to hold in and bring the connector (58) into said first position when the lateral edges (2) of the screen are moving in the guide channels and, allowing the connector to pivot towards said second position for the reinsertions of the edges (2) which might have become disengaged from the guide channels (3).

6. A device according to claim 5, wherein the connector (58) has an internal cross-section identical to that of the two fixed portions (3*a*), 3*b*) of the guide channels, so that when the connector (58) is in the first position, it forms with the two fixed portions a continuous guide channel.

7. A closing device comprising a flexible screen (1) having lateral edges (2) guided in guide channels (3) to permit the screen (1) to be moveable between a closed position and an open position, wherein said edges (2) are substantially incompressible in a direction of movement of the screen towards the closed position in a longitudinal direction of said edges, and driving means for applying a thrust force on the lateral edges (2) in the longitudinal direction of the edges when in the guide channels (3) to move the screen towards the closed position;

wherein the screen (1) is provided, at the lateral edges (2), with a series of separate substantially rigid link members which are incompressible along the longitudinal direction of the lateral edges (2), the rigid link members bearing against one another, in the longitudinal direction of the lateral edges (2), and the rigid link members being articulated with respect to teach other in order to allow the screen (1) to be moved to an open position;

wherein said guide channels (3) are parallel and perpendicular to ground on which said guide channels are erected and the screen moves to the open position and the closed position within said guide channels.

8. A device according to claim 7, wherein the rigid link members surround at least partially the lateral edges (2) of the screen (1), forming a protrusion with respect to a surface of the lateral edges (3) the protrusion being moveably held in the guide channels (3).

9. A device according to claim 8, wherein the lateral edges (2) of the screen (1) have a substantially continuous bead (7) around which are fixed the rigid link members.

10. A device according to claim 9, wherein the rigid link member are formed as sleeves (6) having a wall with a longitudinal slot (9) through which the screen (1) extends, said slot defining two flanges (10, 11) extending on either side of the slot, a first flange (10) of said flanges having a length in a direction of the lateral edges (2) of the screen (1) less than that of the second flange (11) of said flanges, such that a gap (12) is formed on a first side of the screen (1) between two consecutive rigid link members allowing the flexion of the edge (2) transversely to the plane of the screen (1) on the first side, the second flange (11) of the consecutive link members (5) being able to bear end to end against one another in the longitudinal direction of the lateral edges (2) of the screen (1).

11. A device according to claim 10, wherein the sleeves (6) of the rigid link members (5) moveable in the guide channels (3) have a polygonal cross-section substantially corresponding to that of the sleeves.

12. A device according to claim 10, wherein the lateral edges (2) of the screen (1) are fitted in the rigid link members with a degree of play.

13. A device, according to claim 10, wherein consecutive rigid link members fixed to the lateral edges (2) of the screen (1) work with each other through an intermediary ball-joint coupling (28).

14. A device according to claim 13, wherein the rigid link members are formed by two flanges (10", 11") and articulated with each other, and are fixed on either side of the lateral edges (2) of the screen (1) by pins (14) penetrating into the surface of the screen.

15. A device according to claim 13, wherein the ball-joint coupling (28) comprises a spherical seating (29) at one end of the rigid link member of said members and a pivot with a spherical head (3) at an opposite end of the rigid link member, the head of the pivot (30) of the rigid link member being articulated in the seating (29) of a following adjacent rigid link member of said members.

16. A device according to claim 15, wherein the pivot (30) is split in the longitudinal direction of the lateral edges (2) in order to be compressed elastically in the spherical seating.

17. A device according to claim 16, wherein the pivot (30) extends around the bead (7) provided at the lateral edges (2) of the screen.

18. A device according to claim 8, wherein the rigid link members (5) have rollers (26) held in and rolling inside the guide channels.

19. A device according to claim 7, wherein when the screen (1) is in an open position the screen is rolled up around an axis (17), and the guide channels extend around the axis (17) in a spiral (18) in a plane perpendicular to the axis, wherein in the open position, the lateral edges (2) of the screen (1) are held in the spiral guide channels (18).

20. A device according to claim 19, wherein a radial distance between turns of the spiral guide channels (18), is such that, in the rolled up position, superimposed layers of the screen do not touch each other.

21. A closing device, according to claim 7, comprising a flexible screen (1), of which the lateral edges (2) are held and guided in guide channels (3) to move the screen (1) between the closed position and an open position, wherein the screen is substantially stretched between these guide channels at least in the closed position by screw means for avoiding compression of the lateral edges (2) of the screen (1) in a lengthwise direction at least during the movement towards the closed position and, a stiffening element in the proximity of a free edge of the screen towards the closed position.

22. A device according to claim 7, wherein the lateral edges (2) of the screen (1) are held by friction in the guide channel, so as to prevent the screen from being moved by the weight of the screen between an open position and the closed position when the screen does not extend horizontally.

23. A device according to claim 7, wherein the rigid link members on the screen (1) are rigid small blocks separated from each other by a seal (13) made of a flexible and substantially incompressible material protruding from the rigid small blocks with respect to the screen (1).

24. A device according to claim 7, wherein the rigid link members have an elastic section (10*a*, 11*a*) in a direction transverse to the plane of the screen (1) and sliding in the guide channels so that, when traction is applied to the rigid link members in the plane of the screen (1), the elastic section (10*a*, 11*a*) compresses elastically and allows the edges (2) of the screen (1) to disengage from the guide channels (3).

25. A device according to claim 7, wherein the screen (1) has stiffening means outside the guide channels proximate to the lateral edges, said stiffening means being flexible to the direction of movement of the screen (1') to render the lateral edges (2) substantially incompressible in the lengthwise direction.

26. A device according to claim 25, wherein the stiffening means comprises a notched belt (1') integral with the screen (1) and extending along at least one of the lateral edges (2) of the screen, the driving means working with said notched belt.

27. A device according to claim 26, wherein the rigid link members moving in the guide channels are formed by a series of small blocks articulated with respect to each other, the driving means comprising teeth or protrusions that can penetrate between two consecutive small blocks in order to engage with the lateral edge.

28. A device according to claim 7, wherein the rigid link members on the lateral edges are formed by an articulated chain parallel to the lateral edges (2), wherein the driving means have teeth to engage links of the articulated chain (15).

29. A device according to claim 7, wherein the driving means for applying a thrust force on the lateral edges comprises a transmission (16) able to be moved along the guide channels (18) or in guide channels, with a backward and forward motion while working with the lateral edges (2) of the screen (1), to move the screen between an open position and the closed position.

* * * * *